United States Patent [19]

Nakamine et al.

[11] Patent Number: 4,892,858

[45] Date of Patent: Jan. 9, 1990

[54] HEAT SENSITIVE TRANSFER MATERIALS

[75] Inventors: Takeshi Nakamine; Kozo Sato, both of Kanagawa, Japan

[73] Assignee: Fuji Photo Film Co., Ltd., Kanagawa, Japan

[21] Appl. No.: 272,034

[22] Filed: Nov. 16, 1988

[30] Foreign Application Priority Data

Nov. 16, 1987 [JP] Japan ..... 62-288971

[51] Int. Cl.[4] ..... B41M 5/035; B41M 5/26

[52] U.S. Cl. ..... 503/227; 8/471; 428/195; 428/336; 428/488.1; 428/913; 428/914

[58] Field of Search ..... 8/471; 428/913, 914, 428/195, 336, 488.1; 503/227

[56] References Cited

U.S. PATENT DOCUMENTS 4,137,042 1/1979 Defago et al. ..... 8/471

FOREIGN PATENT DOCUMENTS 0178832 4/1986 European Pat. Off. ..... 503/227

*Primary Examiner*—Bruce H. Hess

*Attorney, Agent, or Firm*—Sughrue, Mion, Zinn, Macpeak & Seas

[57] ABSTRACT

A heat sensitive transfer material is disclosed, comprising a support having provided thereon a layer containing a dye represented by formula (I)

(I)

wherein $R^1$ represents an aliphatic group which has from 1 to 6 carbon atoms, an aromatic group which has from 4 to 10 carbon atoms, an acyl group, an acyloxy group, an alkoxycarbonyl group, an acylamino group, a carbamoyl group, a sulfonamido group, a sulfamoyl group, an imido group, a urethane group, a ureido group, a sulfonyl group, a hydroxyl group, a cyano group, a carboxyl group, a nitro group or a halogen atom; m represents an integer of from 0 to 3; when $m \geqq 2$ the $R^1$ groups may be the same of different and may be joined together to form a ring; $R^2$ and $R^3$ each independently represents an aliphatic group which has from 1 to 6 carbon atoms or an aromatic group, and $R_2$ and $R^3$ may be joined together to form a ring, $R^4$ represents a halogen atom, an alkoxy group, an aliphatic group which has from 1 to 6 carbon atoms or an aromatic group which has from 4 to 10 carbon atoms; n represents an integer of from 0 to 3; and when $n \geqq 2$ the $R^4$ groups may be the same or different. $R^5$ and $R^6$ each independently represents hydrogen atom, an aliphatic group which has from 1 to 6 carbon atoms, or an aromatic group which has from 4 to 10 carbon atoms, and $R^5$ and $R^6$ may have substituent groups which contain hetero atoms. $R^5$ and $R^6$ may also be joined together to form a ring. Furthermore, $R^5$ and/or $R^6$ may be joined to $R^4$ to form a ring. $R^1$ to $R^6$ may be further substituted with separate substituent groups.

10 Claims, 1 Drawing Sheet

HEAT SENSITIVE TRANSFER MATERIALS

FIELD OF THE INVENTION

This invention concerns heat sensitive transfer materials and, more precisely, it concerns novel heat sensitive transfer materials with which recorded images of excellent hue can be imposed easily on a material to be recorded.

BACKGROUND OF THE INVENTION

Color recording techniques involving development, electrophotography, ink jets and heat sensitive transfer have been employed in the prior art.

The heat sensitive transfer recording system is thought to have an advantage over the other methods since the apparatus used is easy to maintain and operate and both the apparatus and the consumables are cheap.

Heat sensitive transfer systems include fusion systems in which a transfer sheet having a layer of thermally fusible ink formed on a base film or support is heated by means of a thermal head and the ink is melted and transferred onto the material to be recorded, and sublimation systems in which a transfer sheet having a colored material layer containing a sublimable dye formed on a base film or support is heated by means of a thermal head and the dye is sublimed and transferred onto the material to be recorded. However, it is possible to control the amount of dye which is sublimed in a sublimation system by varying the amount of energy which is being supplied to the thermal head and so it is easy to obtain graded recordings and this is especially useful in the case of full color recording.

Transfer recording can be carried out using transfer materials which have a cyan dye in the colored material layer in order to obtain cyan recordings with the heat sensitive transfer recording systems mentioned above, but in the past satisfactory performance has not been achieved with cyan transfer materials and the development of such materials is desirable.

The dyes which are suitable for use in transfer materials of the sublimation type in particular should be transferred easily within the heating temperature range of the thermal recording head, they should not undergo thermal degradation at this time, and they should have the preferred hue for color reproduction and a high molecular extinction coefficient. Moreover, they should be stable in respect of heat, light, moisture and chemical attack, they should be easy to synthesize, and they should have excellent ink forming properties, which is to say dissolution and dispersion properties, etc.

However, the dyes proposed in the past have lacked clarity as cyan dyes since, for example, the anthraquinone dyes and naphthoquinone dyes disclosed in JP-A-60-151097 and JP-A-60-151098 (the term "JP-A" as used herein signifies "unexamined published Japanese patent application") have a broad absorption spectrum and a blue coloration rather than a cyan coloration because the .peak absorption wavelength is on the short wavelength side, and the indoaniline dyes disclosed in JP-A-61-22993 also have a broad absorption spectrum with a large secondary absorption in the yellow part of the spectrum.

SUMMARY OF THE INVENTION

This invention is intended to provide heat sensitive transfer materials which contain a cyan dye which satisfies the above mentioned requirements and which has an especially good hue.

The above mentioned aim of the invention is achieved by means of heat sensitive transfer materials which have a layer which contains dye which can be represented by the general formula (I) indicated below on a support.

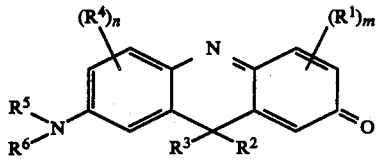

(I)

In this formula, $R^1$ represents an aliphatic group which has from 1 to 6 carbon atoms, an aromatic group which has from 4 to 10 carbon atoms, acyl group, acyloxy group, alkoxycarbonyl group, acylamino group, carbamoyl group, sulfonamido group, sulfamoyl group, imido group, urethane group, ureido group, sulfonyl group, hydroxyl group, cyano group, carboxyl group, nitro group or a halogen atom; m represents a integer of from 0 to 3; when $m \geqq 2$ the $R^1$ groups may be the same of different; and the two or more $R^1$ groups may be joined together to form a ring. $R^2$ and $R^3$ each independently represents an aliphatic group which has from 1 to 6 carbon atoms or an aromatic group which has from 4 to 10 carbon atoms, and they may be joined together to form a ring. $R^4$ represents a halogen atom, an alkoxy group, an aliphatic group which has from 1 to 6 carbon atoms or an aromatic group which has from 4 to 10 carbon atoms; n represents an integer of from 0 to 3; and when $n \leqq 2$ the $R^4$ groups may be the same or different $R^5$ and $R^6$ each independently represents hydrogen atom, an aliphatic group which has from 1 to 6 carbon atoms or an aromatic group which has from 4 to 10 carbon atoms, and $R^5$ and $R^6$ may have substituent groups which contain hetero atoms. $R^5$ and $R^6$ may also be joined together to form a ring. Furthermore, $R^5$ and/or $R^6$ may be joined to $R^4$ to form a ring. $R^1$ to $R^6$ may be further substituted with separate substituent groups.

DETAILED DESCRIPTION OF THE INVENTION

Figure 1:
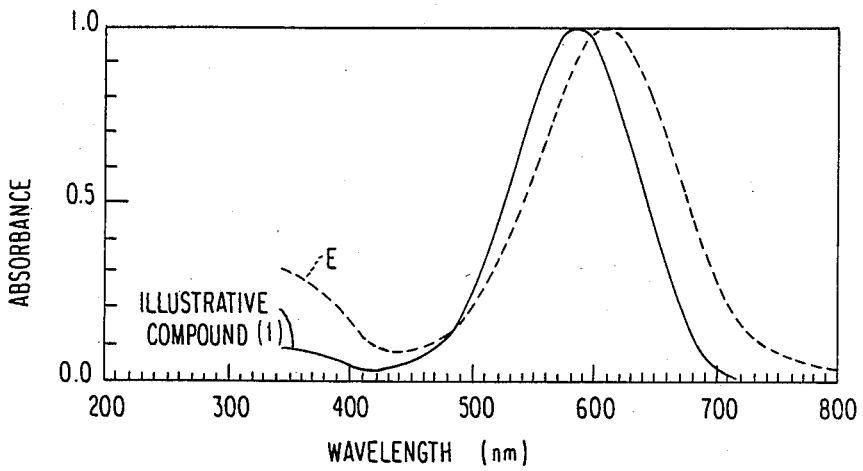
FIG. 1 shows the visible absorption spectra, in methanol, of Illustrative Compound (1) and employed in one embodiment of the present invention and a Comparison Compound E (the absorbance at maximum absorption has been standardized).

The general formula (I) is described in detail below.

$R^1$ represents an aliphatic group which has from 1 to 6 carbon atoms (for example, methyl, ethyl, isopropyl, cyclohexyl, allyl), an aromatic group which has from 4 to 10 carbon atoms (for example, phenyl, pyridyl), an acyl group (for example, acetyl, benzoyl), an acyloxy group (for example, acetoxy, benzoyloxy), an alkoxycarbonyl group (for example, methoxycarbonyl, ethoxycarbonyl), an acylamino group (for example, acetylamino, trifluoroacetylamino, benzoylamino, pentafluorobenzoylamino), a carbamoyl group (for example, ethylcarbamoyl, dimethylcarbamoyl, o-chlorophenylcarbamoyl, p-cyanophenylcarbamoyl), a sulfonamido group (for example, methanesulfonamido), a sulfamoyl group (for example, methylsulfamoyl), a sulfamido group (for example, dimethylsulfamoylamino), an imido group (for example, succinimido, hydantoynyl), a urethane group (for example, phenylurethane, dimethylurethane), a ureido group (for example, phenylureido, dimethylureido), a sulfonyl group (for example, methanesulfonyl, phenylsulfonyl), a hydroxyl group, a cyano group, a carboxyl group, a nitro group, or a halogen atom (for example, F, Cl, Br); m represents an integer of from 0 to 3; and when $m \geqq 2$ the $R^1$ groups may be the same or different. Moreover, adjacent $R^1$ groups may be joined together to form a carbon ring, an aromatic ring or a heterocyclic ring.

Among these groups the electron withdrawing groups (for example, acyl, alkoxycarbonyl, acylamino, sulfonamido, carbamoyl, sulfamoyl, sulfonyl, cyano, and nitro groups and halogen atoms) are preferred for $R^1$.

$R^2$ and $R^3$ each independently represent an aliphatic group which has from 1 to 6 carbon atoms (for example, methyl, ethyl) or an aromatic group which has from 4 to 10 carbon atoms (for example, phenyl), and they may be joined together to form a cyclopentyl ring or a cyclohexyl ring etc. $R^2$ and $R^3$ are preferably lower alkyl groups, especially methyl group.

$R^4$ represents a halogen atom, an alkoxy group (for example, methoxy, ethoxy), an aliphatic group which has from 1 to 6 carbon atoms (for example, methyl, ethyl), or an aromatic group which has from 4 to 10 carbon atoms (for example, phenyl); and n represents an integer of from 0 to 3 and when $n \geqq 2$ the $R^4$ groups may be the same or different. $R^4$ is preferably an alkoxy group or an aliphatic group more preferably an alkyl group).

$R^5$ and $R^6$ represent hydrogen atom, aliphatic groups which have from 1 to 6 carbon atoms (for example, methyl, ethyl, β-hydroxyethyl, β-methanesulfonylaminoethyl) or aromatic groups which have from 4 to 10 carbon atoms (for example, phenyl). $R^5$ and $R^6$ may be joined together to form nitrogen containing rings or rings which contain other hetero atoms. Furthermore $R^5$ and/or $R^6$ may be joined to $R^4$ to form nitrogen containing rings or nitrogen containing rings which contain other hetero atoms.

$R^5$ and $R^6$ are preferably lower alkyl groups, but when $R^5$ and $R^6$ are joined together to form nitrogen containing rings or nitrogen containing rings which contain other hetero atoms, those cases in which $R^5$ and/or $R^6$ are joined to $R^4$ to form nitrogen containing rings or nitrogen containing rings which contain other hetero atoms are preferred.

Each of the groups $R^1$ to $R^6$ include substituted groups, as is clear from the above mentioned illustrative examples.

Preferred examples of actual compounds which can be represented by the general formula (I), and the value of λmax in methanol for each compound, are indicated below by Illustrative Compounds (1) to (30), but the invention is not limited to these examples. In these formulae —Me signifies a $—CH_3$ group, —Et signifies a $—C_2H_5$ group and —Ph signifies a $—C^2H_5$ group and —Ph signifies a

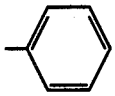

group.

(1)

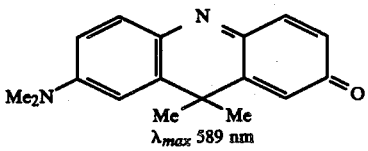

$\lambda_{max}$ 589 nm (2)

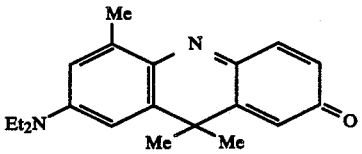

$\lambda_{max}$ 616 nm (3)

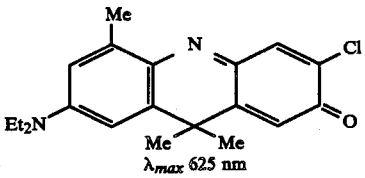

$\lambda_{max}$ 625 nm (4)

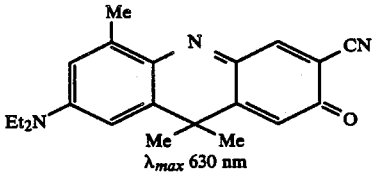

$\lambda_{max}$ 630 nm

-continued
(5)
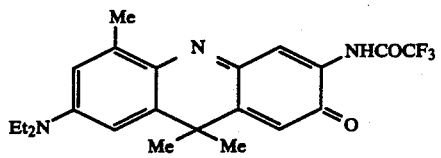
$\lambda_{max}$ 638 nm
(6)
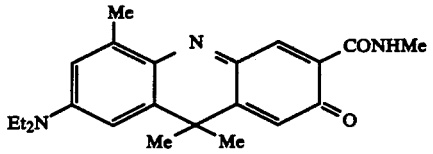
$\lambda_{max}$ 630 nm
(7)
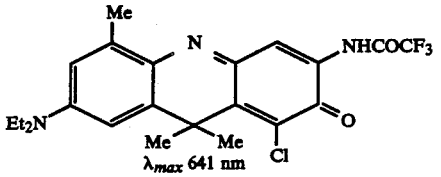
$\lambda_{max}$ 641 nm
(8)
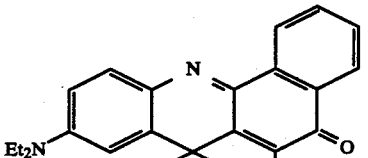
$\lambda_{max}$ 640 nm
(9)
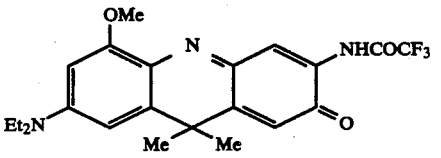
$\lambda_{max}$ 638 nm
(10)
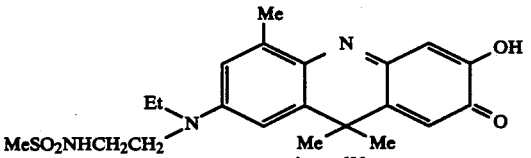
$\lambda_{max}$ 623 nm
(11)
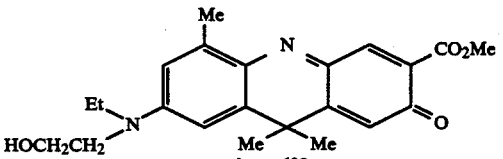
$\lambda_{max}$ 630 nm
(12)
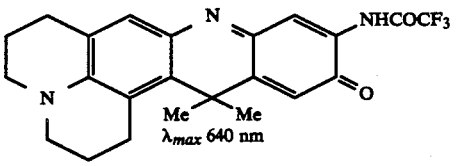
$\lambda_{max}$ 640 nm -continued
(13)
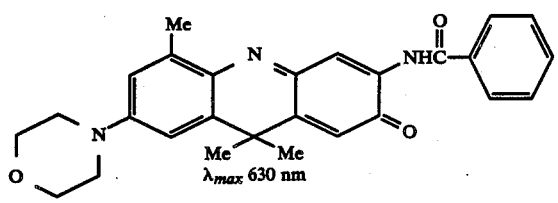
$\lambda_{max}$ 630 nm
(14)
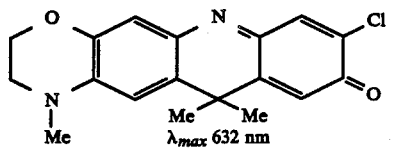
$\lambda_{max}$ 632 nm
(15)
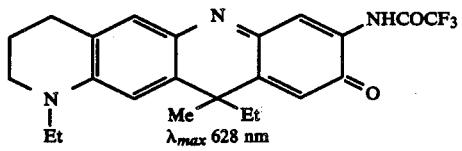
$\lambda_{max}$ 628 nm
(16)
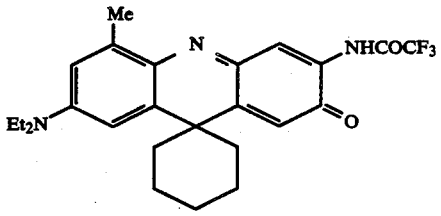
$\lambda_{max}$ 638 nm
(17)
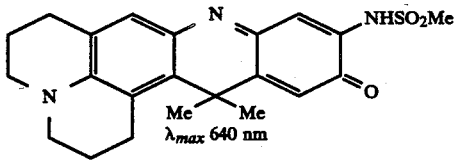
$\lambda_{max}$ 640 nm
(18)
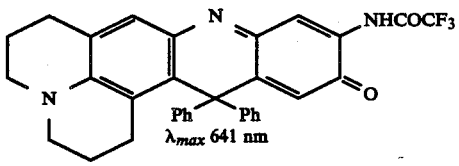
$\lambda_{max}$ 641 nm
(19)
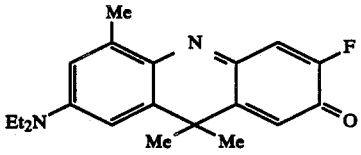
$\lambda_{max}$ 624 nm
(20)
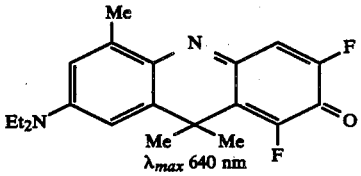
$\lambda_{max}$ 640 nm -continued
(21)
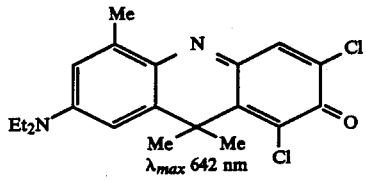
$\lambda_{max}$ 642 nm
(22)
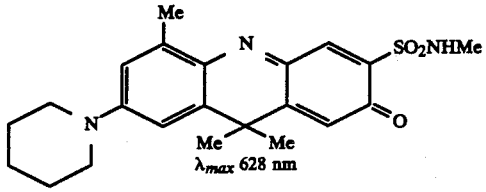
$\lambda_{max}$ 628 nm
(23)
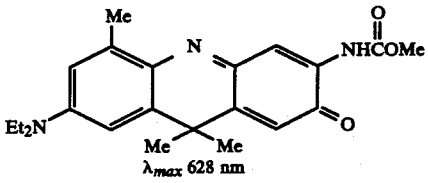
$\lambda_{max}$ 628 nm
(24)
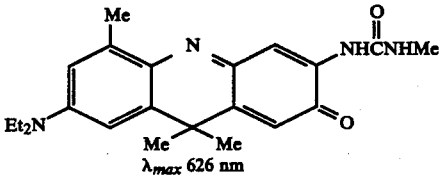
$\lambda_{max}$ 626 nm
(25)
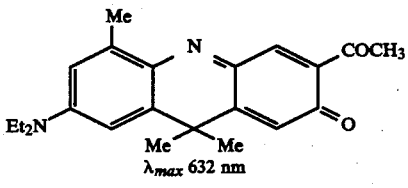
$\lambda_{max}$ 632 nm
(26)
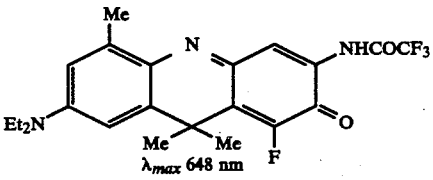
$\lambda_{max}$ 648 nm
(27)
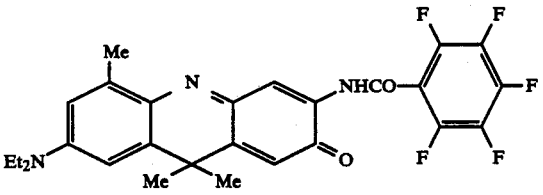
$\lambda_{max}$ 640 nm
(28)
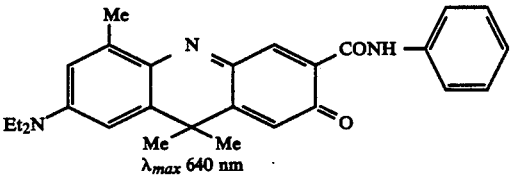
$\lambda_{max}$ 640 nm -continued (29)

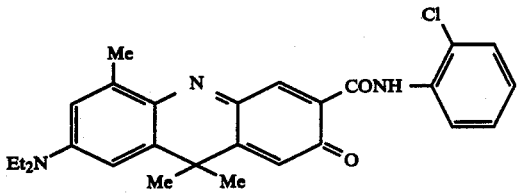

$\lambda_{max}$ 641 nm (30)

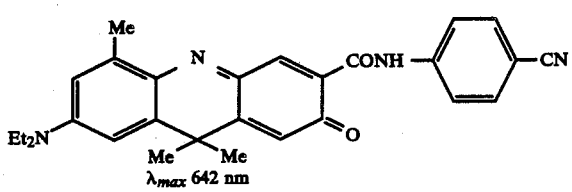

$\lambda_{max}$ 642 nm

Dyes of general formula (I) can be prepared by treating the intermediates C obtained by the oxidative coupling of the compounds A and B indicated below with an acid.

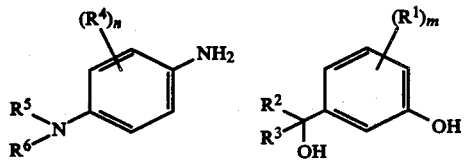

A B

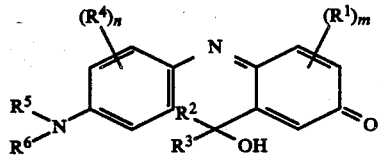

C

In A, B, and C, $R^1$ to $R^6$, m and n have in each case the same meaning as in general formula (I).

In practice, the Illustrated Compound (1), for example, was prepared in the following way.

Five grams of m-isopropenylphenol was dissolved in 100 ml of dichloromethane, hydrogen chloride gas was passed through the solution at 0° C. and, after the reaction had been completed, a saturated aqueous sodium bicarbonate solution was added and the mixture was left to stand overnight. The reaction mixture was then extracted with ethyl acetate, the crude product so obtained was refined using silica gel column chromatography and 4.1 grams of compound B-1 indicated below was obtained.

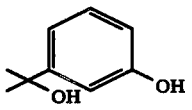

B-1

Next, 1.8 grams of compound B-1 was dissolved in 10 ml of ethanol and then 50 ml of water, 10 grams of sodium carbonate and 1.6 grams of N,N-dimethyl-p-phenylenediamine were added sequentially, after which a solution obtained by dissolving 5.4 grams of ammonium persulfate in 50 ml cf water was added dropwise at room temperature.

After the reaction had been completed, the reaction mixture was extracted with ethyl acetate and the crude product so obtained was refined using silica gel column chromatography, after which it was treated with phosphoric acid. After treatment, the reaction mixture was refined using silica gel column chromotography and the refined dye, Illustrative Compound (1), was obtained (melting point 152° to 155° C.)

The Illustrative Compounds (2) to (30) can also be prepared in a similar manner.

The dyes of general formula (I) have a sharper main absorption spectrum than the conventional indoaniline dyes and less secondary absorption in the yellow part of the spectrum. For example, a comparison of the absorption spectra of the dye shown as Illustrative Compound (1) of this invention and the indoaniline dye E is shown in FIG. 1.

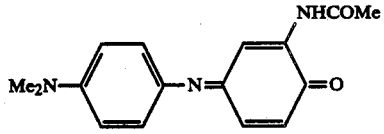

E

The spectrum of the dye shown as Illustrative Compound (1) of this invention is shown as a solid line in FIG. 1 and the absorption spectrum of the conventional dye E is shown by a broken line, and it is clear that the dye of this invention has less secondary absorption in the yellow region and that the absorption spectrum in the main absorption region is sharper.

Heat sensitive transfer materials of this invention are distinguished principally by the use of specified dyes as described above, and in a first embodiment of the invention the cyan dyes of this invention described above are used as thermally mobile dyes in heat sensitive transfer materials which have a heat sensitive sublimation transfer layer consisting of a thermally mobile dye and a binder resin. In this embodiment, the heat sensitive transfer material of this invention is prepared by dissolving or dispersing a dye of this invention and a binder resin in a suitable solvent to form a coating solution and then coating the coating solution onto one side of a support in such a way that the film thickness after drying is for example, from about 0.2 to 5.0 μm, and preferably from 0.4 to 2.0 μm, and drying the coated layer to form a colored material layer and thereby obtain the heat sensitive transfer material.

Furthermore, any of the binder resins known in the art for use in such applications can be used as the binder resin which is used together with the above mentioned dyes, and a rein which is resistant to heat and which does not impede the movement of the dye, is usually selected. Examples of such resins which can be used include polyamide based resins, polyester based resins, epoxy resins, polyurethane based resins, polyacrylate based resins (for example, poly(methyl methacrylate), polyacrylamide), vinyl based resins such as polyvinylpyrrolidone, poly(vinyl chloride) based resins (for example, vinyl chloride-vinyl acetate copolymers) cellulose based resins (for example, methyl cellulose, ethyl cellulose, carboxymethyl cellulose), poly(vinyl alcohol) based resins (for example, poly(vinyl alcohol) partially saponified poly(vinyl alcohol)), acrylic acid based resins, starch based polymers, petroleum based resins, rosin derivatives, coumarone-indene resins, terpene based resins, novolak type phenol based resins, polystyrene based resins, polyolefin based resins (for example, polyethylene, polypropylene), polycarbonates, polysulfones, and polyether sufones.

Binder resins of this type are preferably used, for example, at a rate of from about 80 to 600 parts by weight per 100 parts by weight of dye.

The ink solvents known in the art can be used freely as the ink solvent which is used for the dissolution or dispersion of the above mentioned dyes and binder resins in this invention, and actual examples of such ink solvents include water, alcohols (such as methanol, ethanol, isopropyl alcohol, butanol, isobutanol), esters (such as ethyl acetate, butyl acetate), ketones (such as methyl ethyl ketone, methyl isobutyl ketone, cyclohexanone), aromatic solvents (such as toluene, xylene, chlorobenzene), halogenated solvents (such as dichloromethane, trichloroethane, chloroform), N,N-dimethylformamide, N-methylpyrrolidone, dioxane, tetrahydrofuran, cellosolve based solvents (such as methyl cellosolve, ethyl cellosolve), and mixtures of the above mentioned solvents. These solvents should be selected and used in such a way that the aforementioned dye which is being used can be dissolved or dispersed at least at the prescribed concentration and in such a way that the aforementioned binder resin can be adequately dissolved or dispersed For example, the use of an amount of solvent from about 9 to 20 times the total weight of the aforementioned dye and binder resin is preferred.

Any of the known supports which have a certain degree of heat resistance and strength can be used for the support which is used to form a heat sensitive transfer material of this invention. For example, paper of a thickness of from 0.5 to 50 μm, and preferably of a thickness of from 3 to 10 μm, various types of synthetic paper, polyester films, polystyrene films, polypropylene films, polysulfone films, polycarbonate films, polyphenylene sulfide, poly(vinyl alcohol) films or cellophane can be used for this purpose. The use of polyester films is especially desirable.

The ink can be coated onto the base film (support) by means of a reverse roll coater, a gravure coater, a rod coater or an air doctor coater The heat sensitive transfer materials can be used satisfactorily in the form described above in this invention, but by establishing layers such as an anti-stick layer, which is to say a release layer on the surface of the colored material layer it is possible to prevent the material to be recorded from sticking to the heat sensitive transfer material during heat transfer, and it is also possible to form more dense images since this enables use of higher heat transfer temperatures.

The simple attachment of an inorganic powder which has anti-stick properties has a release layer effect, and release layers can be formed by establishing a layer of from about 0.10 to 5 μm, and preferably of from 0.05 to 2 μm, consisting of a resin which has excellent release properties, such as a silicone polymer, acrylic polymer or a fluorine based polymer.

Moreover, an adequate effect can be achieved by incorporating inorganic powders or release polymers as mentioned above in the colored material layer.

Moreover, a heat resistant layer may be established on the reverse side of the heat sensitive transfer materials of this invention in order to prevent the occurrence of adverse effects due to the heat from the thermal head.

The heat sensitive transfer materials which are preferred embodiments of the invention obtained in the way outlined above are laminated to a known thermal image receiving sheet, and the dye in the colored material layer is transferred easily, in accordance with the magnitude of the heating energy, to the receiving layer of the thermal image receiving sheet at comparatively low energy by heating from either side, but preferably from the heat sensitive transfer material side, in accordance with an image signal using a heating device such as a thermal head, for example and colored images with resolved gradation and excellent sharpness can be formed in this way.

In the second preferred embodiment of the invention, the heat sensitive transfer material contains a heat sensitive fusion type transfer layer comprised of a dye of this invention and wax which form the colored material transfer layer.

The second embodiment of the heat sensitive transfer material can be obtained by preparing a colored layer forming ink material comprised of a wax which contains dye, and forming a colored material layer of the ink on one surface of a prescribed support as described earlier. More specifically, the ink is comprised of a wax which has a suitable melting point, for example, paraffin wax, microcrystalline wax, carnauba wax, or a urethane based wax as a binder, compounded with a dye, which wax and dye have been formed into a dispersion. The proportions of dye and wax used are preferably within a range such that the dye accounts for from about 10 to 65 wt % of the colored material layer which is formed, and the thickness of the layer which is formed is preferably within the range from about 1.5 to 6.0 μm. The known techniques conventionally used for the manufacture of such an ink and for applying the ink to a support can be used.

When used in the same way as the aforementioned first embodiment of the invention, the heat sensitive materials of this second embodiment of the invention transfer the colored layer onto the receiving sheet and provide excellent prints.

The dyes represented by the aforementioned general formula (I) of this invention have a bright cyan color and so they are suitable for providing full color recordings with good color reproduction when combined with the appropriate magenta and yellow colors and, moreover, since the dyes have a large molecular extinction coefficient, it is possible to obtain recordings which have a high color density at high speed without imposing a great load on the thermal head. Moreover, since these dyes are stable in respect of heat, light, moisture and chemical attack etc., there is no thermal degradation during transfer recording and the recordings obtained have excellent storage properties. Furthermore, the dyes of this invention have good solubility in organic solvents or good dispersibility in water and so it is easy to prepare highly concentrated inks which have the form of a uniform solution or dispersion, and by using these inks it is possible to obtain heat sensitive transfer materials on which the dye has been uniformly coated at a high density. Hence, by using these heat sensitive transfer materials it is possible to obtain recordings which have good uniformity and color density.

The invention is described in practical terms below by means of examples, but the invention is not limited by these examples.

EXAMPLE 1

| Preparation of the Ink | |
|---|---|
| Dye (Illustrative Compound (1)) | 4 grams |
| Poly(vinyl butyrate) resin (made by Denki Kagaku Kogyo K.K., Denka ® Butyrate 5000-A) | 4 grams |
| Toluene | 40 ml |
| Methyl ethyl ketone | 40 ml |
| Polyisocyanate (made by Takeda Chemical Industries, Ltd., Takenate ® D 110N) | 0.2 ml |

An ink was prepared by treating a mixture of the composition indicated above for 1 hour in an ink conditioner.

Formation of the Heat Sensitive Transfer Material

The above mentioned ink was coated onto a polyethylene terephthalate film (thickness 6 μm) using a #20 wire bar and then the coated ink was dried naturally to form a colored material layer and thereby obtain a heat sensitive transfer material.

A receiving layer material of the composition indicated below was then coated using the wire bar coating method so as to provide a dry coated weight of 5 grams per square meter onto a synthetic paper (made by Oji Yuka Co., Ltd., Yupo-EPG ® 150) of thickness 150 μm as a base material to provide a thermal image receiving sheet. This was dried by provisional drying in a drier, followed by drying in an oven for 1 hour at a temperature of 100° C. to achieve complete evaporation of the solvent.

| Receiving Layer Ink Composition | |
|---|---|
| Vylon ® 103 (made by Toyobo Co., Ltd., polyester resin) | 8 parts |
| Elvaloy ® 741 (made by Mitsui Polychemicals Co., Ltd., EVA based polymer plasticizer) | 2 parts |
| Amino modified silicone oil (made by Shin-Etsu Silicone Co., Ltd., KF-393) | 0.125 part |
| Epoxy modified silicone oil (made by Shin-Etsu Silicone Co., Ltd., X-22343) | 0.125 part |
| Toluene | 70 parts |
| Methyl ethyl ketone | 10 parts |
| Cyclohexanone | 20 parts |

The thermal image receiving sheet and the heat sensitive transfer material obtained as indicated above were brought together in such a way that the colored material layer and the receiving layer were in contact with one another and a recording was made using a thermal head applied from the support side of the heat sensitive transfer material under the following conditions. Thermal head output: 1 W/dot, Pulse width: 0.3 to 4.5 ms, Dot density: 6 dots/mm. The recording obtained had a clear cyan image. The reflection density of the high density colored part made with a pulse width of 4.5 ms was 1.60, and that in the part made with a pulse width of 0.3 ms was 0.14. The recording exhibited a gradation corresponding to applied energy. (The measurements were made using a Macbeth densitometer RD-918).

EXAMPLES 2 TO 10

Heat sensitive transfer materials were prepared using the same method as used in Example 1 except that the dyes and binders shown in Table 1 were used instead of the dye and binder used in Example 1. The results obtained on making transfer recordings showed a dense, clear, cyan color as shown in Table 1.

TABLE 1

| Example No. | Dye (Illustrative Compound) | Binder | Color density (High Density Region) |
|---|---|---|---|
| 2 | (4) | Poly(vinyl butyrate) Denka ® Butyrate 5000A | 1.65 |
| 3 | (7) | Poly(vinyl butyrate) Denka ® Butyrate 5000A | 1.60 |
| 4 | (9) | Polyvinyl butyrate)Denka ® Butyrate 5000A | 1.55 |
| 5 | (11) | Poly(vinyl butyrate) Denka ® Butyrate 5000A | 165 |
| 6 | (7) | Ethyl cellulose | 1.70 |
| 7 | (12) | Ethyl cellulose | 1.50 |
| 8 | (13) | Ethyl cellulose | 1.65 |
| 9 | (15) | Polysulfone Udel ® P1700 (made by Nissan Chemical Co., Ltd.) | 1.50 |
| 10 | (17) | Polysulfone Udel ® P1700 (made by Nissan Chemical Co., Ltd.) | 1.55 |

EXAMPLE 11

Hexamethylene diisocyanate and ethyl alcohol were mixed together in such a way that the —NCO and —OH groups were equimolar and a wax was obtained by heating the mixture to 80° C., with stirring, for a period of 10 hours. The melting point of the product obtained was 83 to 86° C. and the absence of -NCO groups was confirmed using infrared spectrometry.

A gravure ink composition of viscosity (at 25° C.) 300 c.p. was prepared using the above mentioned product and the ingredients indicated below with agitation at normal temperature in a ball mill.

| Gravure Ink Composition | |
|---|---|
| Product mentioned above | 30 parts |
| Dye (Illustrative Compound (1)) | 3 parts |
| Ethyl alcohol | 50 parts |

-continued

| Gravure Ink Composition | |
|---|---|
| Isopropyl alcohol | 17 parts |

A heat sensitive transfer material of this invention was prepared using the gravure ink composition so obtained by gravure coating in such a way as to provide a dry coated film thickness of 3 μm on the same polyethylene terephthalate film of thickness 8 μm as used in Example 1. On printing letters with a printer fitted with a thermal head (made by Toshiba Corporation, F-1610), cyan colored letters with a clear outline were obtained.

EXAMPLE 12

The ink used in Example 1 was coated in the same way as in Example 1 on one side of a polyethylene terephthalate film (thickness 4 μm) and, after drying, a resistance layer, of which the composition is indicated below, was coated onto the back of the film and dried to provide an electrically conductive type heat sensitive transfer material.

Composition of Resistance Layer

| Ingredient | Proportion Used (wt %) |
|---|---|
| Toluene | 25 |
| Methyl ethyl ketone | 25 |
| Methyl isobutyl ketone | 25 |
| Polyester (Vylon ® 290, Toyobo Co., Ltd.) | 15 |
| Carbon black | 7 |
| Dispersing agent | 3 |

The ink coated surface of this transfer material was aligned in contact with the receiving layer coated surface of an image receiving paper and transfer recording was carried out by heating, i.e., by passing electricity from electrodes on the resistance layer side. The electrodes provided 6 dots/mm and the applied energy was 0.8 mJ/dot. A clear cyan image was recorded on the image receiving paper.

While the invention has been described in detail and with reference to specific embodiments thereof, it will be apparent to one skilled in the art that various changes and modifications can be made therein without departing from the spirit and scope thereof.

What is claimed is:

1. A heat sensitive transfer material comprising a support having provided thereon a layer containing a binder and a dye represented by formula (I)

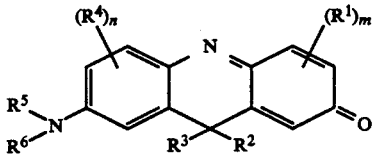

(I)

wherein $R^1$ represents an aliphatic group which has from 4 to 10 carbon atoms, an aromatic group which has from 4 to 10 carbon atoms, an acyl group, an acyloxy group, an alkoxycarbonyl group, an acylamino group, a carbamoyl group, a sulfonamido group, a sulfamoyl group, an imido group, a urethane group, a ureido group, a sulfonyl group, a hydroxyl group, a cyano group, a carboxyl group, a nitro group or a halogen atom; m represents an integer of from 0 to 3; when $m \geqq 2$ the $R^1$ groups may be the same of different and may be joined together to form a ring; $R^2$ and $R^3$ each independently represents an aliphatic group which has from 1 to 6 carbon atoms or an aromatic group which has from 4 to 10 carbon atoms, and $R^2$ and $R^3$ may be joined together to form a ring; $R^4$ represents a halogen atom, an alkoxy group, an aliphatic group which has from 1 to 6 carbon atoms or an aromatic group which has from 4 to 10 carbon atoms; n represents an integer of from 0 to 3; when $n \geqq 2$ the $R^4$ groups may be the same or different; and $R^5$ and $R^6$ each independently represents a hydrogen atom, an aliphatic group which has from 1 to 6 carbon atoms, or an aromatic group which has from 4 to 10 carbon atoms, $R^5$ and $R^6$ may have substituent groups which contain hetero atoms, $R^5$ and $R^6$ may be joined together to form a ring, and $R^5$ and/or $R^6$ may be joined to $R^4$ to form a ring.

2. A heat sensitive transfer material as in claim 1, wherein $R^1$ represents methyl group, ethyl group, isopropyl group, cyclohexyl group, allyl group, phenyl group, pyridyl group, acetyl group, benzoyl group, acetoxy group, benzoyloxy group, methoxycarbonyl group, ethoxycarbonyl group, acetylamino group, trifluoroacetylamino group, benzoylamino group, pentafluorobenzoylamino group, ethylcarbamoyl group, dimethylcarbamoyl group, o-chlorophenylcarbamoyl group, p-cyanophenylcarbamoyl group, methanesulfonamido group, methylsulfamoyl group, dimethylsulfamoylamino group, succinimido group, hydantoynyl group, phenylurethane group, dimethylurethane group, phenylureido group, dimethylureido group, methanesulfonyl group, phenylsulfonyl group, or an F, Cl, or Br atom.

3. A heat sensitive transfer material as in claim 1, wherein $R^1$ is an acyl group, alkoxycarbonyl group, acylamino group, sulfonamido group, carbamoyl group, sulfamoyl group, sulfonyl group, cyano group, nitro group or a halogen atom.

4. A heat sensitive transfer material as in claim 1, wherein $R^2$ and $R^3$ each independently represents methyl group, ethyl group or phenyl group, and $R^2$ and $R^3$ may be joined together to form a cyclopentyl ring or a cyclohexyl ring.

5. A heat sensitive transfer material as in claim 1, wherein $R^4$ represents a halogen atom, methoxy group, ethoxy group, methyl group, ethyl group, or phenyl group.

6. A heat sensitive transfer material as in claim 1, wherein $R^5$ and $R^6$ are lower alkyl groups, and $R^5$ and/or $R^6$ may be joined to $R^4$ to form nitrogen containing rings or nitrogen containing rings which contain other hetero atoms.

7. A heat sensitive transfer material as in claim 1, wherein said layer is a heat sensitive sublimation transfer layer comprised of a binder resin and said dye.

8. A heat sensitive transfer material as in claim 7, wherein said heat sensitive transfer material is prepared by dissolving or dispersing said dye and said binder resin in a solvent to form a coating solution and then coating said coating solution onto one side of a support in such a way that the film thickness of the coating after drying is from about 0.2 to 5.0 μm, and drying coating to form the transfer layer.

9. A heat sensitive transfer material as in claim 1, wherein said layer is a heat sensitive fusion transfer layer comprised of said dye and a wax.

10. A heat sensitive transfer material as in claim 9, wherein said layer is obtained by dispersing said dye in said wax to form a colored material and coating said colored material on the surface of said support to form a colored material layer.

* * * * *